US010638829B1

(12) United States Patent
Haverman et al.

(10) Patent No.: US 10,638,829 B1
(45) Date of Patent: May 5, 2020

(54) PROTECTIVE TOOTHBRUSH

(71) Applicant: ZENT, LLC, Austin, TX (US)

(72) Inventors: Lee Haverman, Austin, TX (US); Christopher Michael Owens, Austin, TX (US); Kit Morris, Austin, TX (US)

(73) Assignee: ZENT, LLC, Austin, TX (US)

( * ) Notice: Subject to any disclaimer, the term of this patent is extended or adjusted under 35 U.S.C. 154(b) by 0 days.

(21) Appl. No.: 16/191,020

(22) Filed: Nov. 14, 2018

(51) Int. Cl.
*A46B 5/00* (2006.01)
*A46B 9/04* (2006.01)
*A46B 5/02* (2006.01)

(52) U.S. Cl.
CPC ..... *A46B 5/007* (2013.01); *A46B 5/0041* (2013.01); *A46B 5/02* (2013.01); *A46B 9/04* (2013.01); *A46B 2200/1066* (2013.01)

(58) Field of Classification Search
CPC ..... A46B 5/007; A46B 5/0054; A46B 5/0058; A46B 5/0062; A46B 5/0006; A46B 9/04; A46B 2200/1066; A46B 5/0041; A46B 5/02
See application file for complete search history.

(56) References Cited

U.S. PATENT DOCUMENTS 759,490 A * 5/1904 Yates ..... A46B 5/02 15/143.1
5,146,645 A * 9/1992 Dirksing ..... A46B 5/0062 15/167.1
5,630,244 A * 5/1997 Chang ..... A46B 5/0062 15/143.1
5,673,452 A * 10/1997 Chang ..... A46B 5/0062 15/143.1
6,599,048 B2 7/2003 Kuo
6,883,200 B1 * 4/2005 Euler ..... A46B 5/0062 15/167.1
6,895,630 B2 5/2005 Tini
9,226,808 B2 1/2016 Utsch et al.
2005/0108841 A1 * 5/2005 Edwards ..... A46B 5/0062 15/167.1
2006/0096052 A1 5/2006 Parisi
(Continued)

FOREIGN PATENT DOCUMENTS

CN 86208447 7/1987
CN 201299257 9/2009
(Continued)

*Primary Examiner* — Weilun Lo
(74) *Attorney, Agent, or Firm* — Bracewell LLP; Brad Y. Chin

(57) ABSTRACT

A toothbrush protective of tissues may include an elongated toothbrush handle assembly including an elongated biasing member including a bridge hinge axis perpendicular to a major longitudinal axis and configured for flexing movement about a bridge hinge axis in common with flexing movement of a major transition member about a transition member hinge axis proximate the bridge hinge axis, a major handle member which may include a handle member first connection configured to receive a biasing member first end and a handle member second connection configured to receive a transition member first end, and a major head member which may include a head member first connection configured to receive a biasing member second end and a head member second connection configured to receive a transition member second end.

6 Claims, 7 Drawing Sheets

(56) References Cited

U.S. PATENT DOCUMENTS

| | | | | |
|---|---|---|---|---|
| 2011/0016651 | A1* | 1/2011 | Piserchio | A46B 5/007 15/167.1 |
| 2013/0227806 | A1* | 9/2013 | Scholze | A46B 9/04 15/167.1 |

FOREIGN PATENT DOCUMENTS

| | | |
|---|---|---|
| CN | 201528797 | 7/2010 |
| CN | 201879057 | 6/2011 |
| JP | 2012019973 | 2/2012 |

* cited by examiner

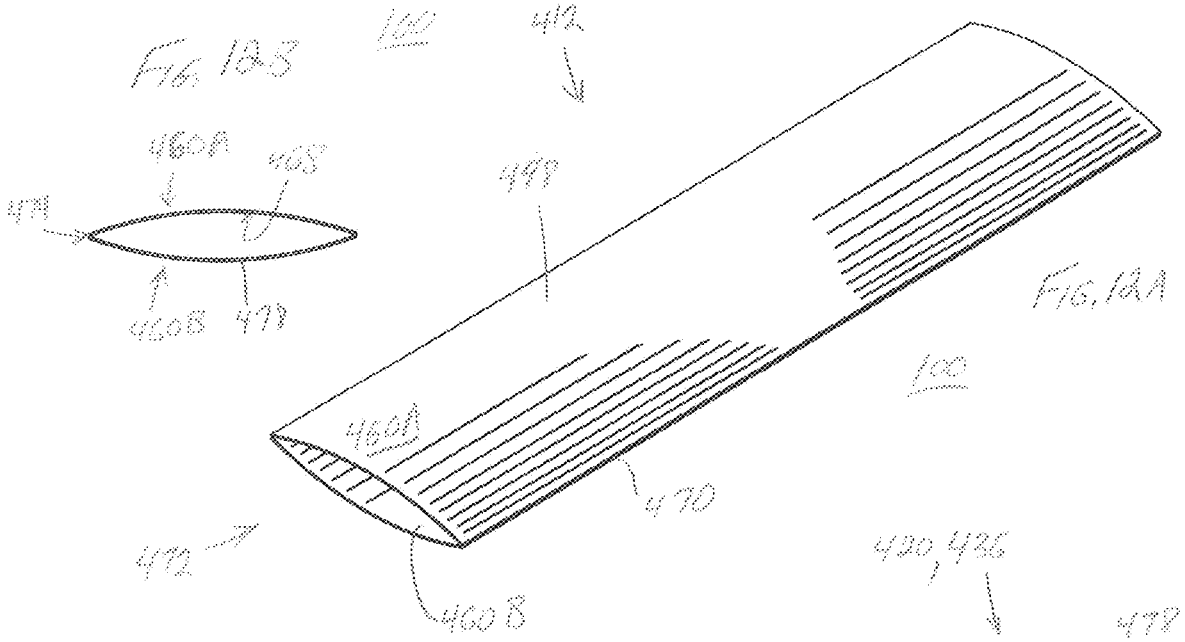
FIG. 12B
100
412
460A
466
474
460B
478
498
FIG. 12A
100
460A
470
472
460B
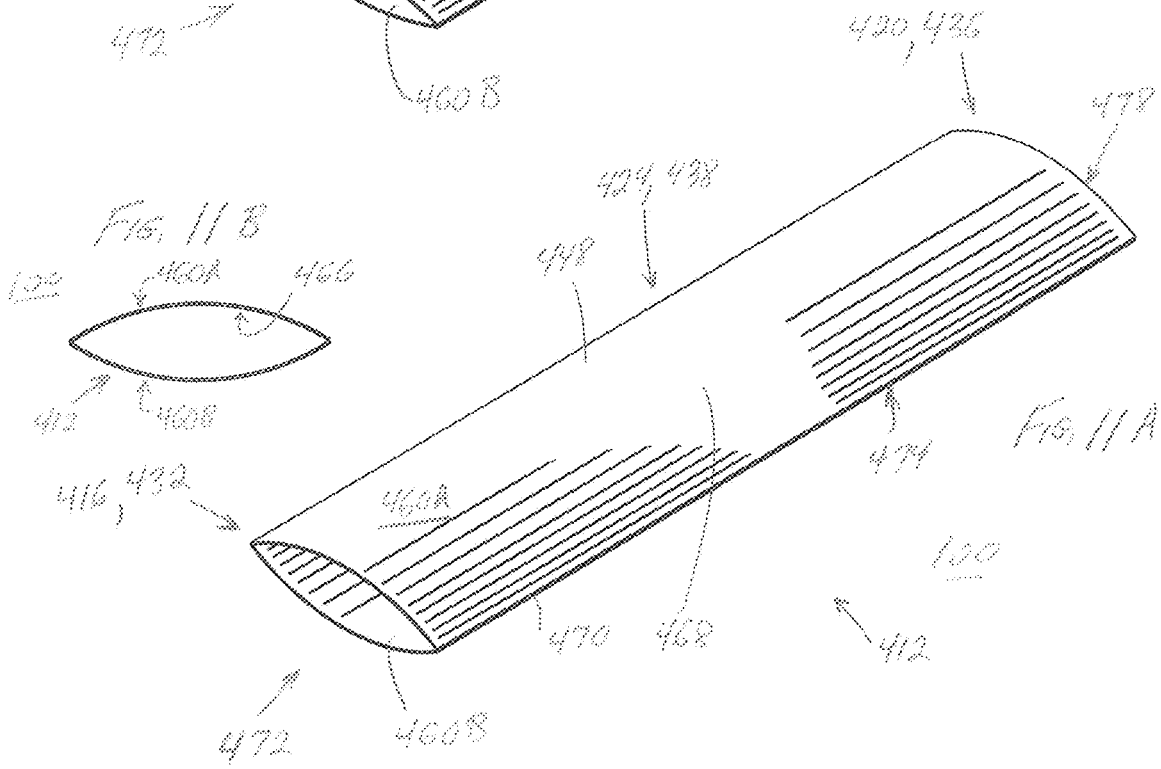
420, 426
478
FIG. 11B
100
460A
466
474
460B
416, 432
FIG. 11A
100
460A
470
468
412
472
460B

PROTECTIVE TOOTHBRUSH

CROSS REFERENCE TO RELATED APPLICATIONS

This application is not related to any pending applications on the date of filing.

FIELD OF THE INVENTION

The disclosure relates generally to toothbrushes and particularly to toothbrushes that protect teeth and gum tissues, by eliminating or reducing damage to the teeth and gum tissues due to application of excessive force during use.

BACKGROUND OF THE INVENTION

Vigorous brushing of the teeth with excessive force can cause damage to teeth and gum tissue. Attempts have been made to produce protective toothbrushes that yield in response to excessive manual force being exerted on teeth and gum tissues by the toothbrush. One example is disclosed in U.S. Pat. No. 5,146,645 issued to Robert S. Dirksing on Sep. 15, 1992, which is hereby incorporated by reference in entirety. The Dirksing toothbrush includes a force indicator that is intended to visually and tactually signal the user when a predetermined brushing force is exceeded. U.S. Pat. No. 5,054,154 issued to Schiffer et al. on Oct. 8, 1999, which is hereby incorporated by reference in entirety, discloses a flexible toothbrush intended to allow the bristle head to move out of the way in the event of excessive brushing pressure being applied during use. U.S. Pub. No. 2011/0016651 A1 (Piserchio) published Jan. 27, 2011, which is hereby incorporated by reference in entirety, discloses a pressure-sensitive toothbrush including a ball and socket joint that is intended to become disengaged and temporarily disabled for toothbrushing, when the user exerts too much pressure on the toothbrush. Toothbrushes in the prior art may suffer various problems, including: undesired complexity in usage, imprecise mechanisms of operation, poor durability, breakage during use, constructions that are unrepairable when components are broken or worn, untimely wear of the pressure sensitive mechanisms, and complexity in manufacturing. For reasons stated above and for other reasons which will become apparent to those skilled in the art upon reading and understanding the present specification, there is a need in the art for improved protective toothbrushes.

BRIEF DESCRIPTION OF THE INVENTION

The above-mentioned shortcomings, disadvantages and problems are addressed herein, as will be understood by those skilled in the art upon reading and studying the following specification.

This Summary is provided to introduce a selection of concepts in a simplified form that are further described below in more detail in the Detailed Description. This Summary is not intended to identify key or essential features of the claimed subject matter.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

In embodiments, protective toothbrushes may be configured to protect teeth, gum tissues or both, from application of excessive manual forces that may be detrimental to health or condition of the same. Protective toothbrushes of this disclosure may prevent application of forces to tissues with high precision. Toothbrushes, in embodiments, may be useable with low complexity. Embodiments may include a precise mechanism of protective operation. Protective toothbrushes as herein disclosed may be of highly durable. A protective toothbrush in accordance with embodiments may function without suffering breakage, or have reduced frequency of breakage in use. Protective toothbrushes may have a construction that is repairable when components are broken or worn, and components may be replaceable. Toothbrushes as herein disclosed may enjoy reduced wearing of the pressure sensitive mechanisms. In embodiments as disclosed, a protective toothbrush may be manufactured with reduced, low complexity.

Embodiments of varying scope are described herein. These aspects are indicative of various non-limiting ways in which the disclosed subject matter may be utilized, all of which are intended to be within the scope of the disclosed subject matter. In addition to the aspects and advantages described in this summary, further aspects, features, and advantages will become apparent by reference to the associated drawings, detailed description, and claims.

BRIEF DESCRIPTION OF THE DRAWINGS

The disclosed subject matter itself, as well as further objectives, and advantages thereof, will best be illustrated by reference to the following detailed description of embodiments of the device read in conjunction with the accompanying drawings, wherein:

FIG. 3 is a simplified perspective exploded view of toothbrush 100 shown in

FIG. 1.

FIG. 11A is an enlarged isolation schematic perspective view illustrating the spring assembly in enabling position and low load shape as shown in FIG. 9, corresponding to toothbrush 100 in the enabled condition shown generally in FIG. 9.

FIG. 11B is a schematic cross-section view taken generally along 11B-11B in FIG. 11A, illustrating the spring assembly in enabling position and low load shape.

FIG. 12A is an enlarged isolation schematic perspective view similar to FIG. 11A, illustrating the spring assembly in enabling position and sub-threshold shape, corresponding to toothbrush 100 in the enabled condition shown generally in FIG. 9.

FIG. 12B is a schematic cross-sectional view taken generally along 12B-12B in FIG. 12A, illustrating the spring assembly in enabling position and sub-threshold shape.

DETAILED DESCRIPTION OF THE INVENTION

Figures 1, 2:
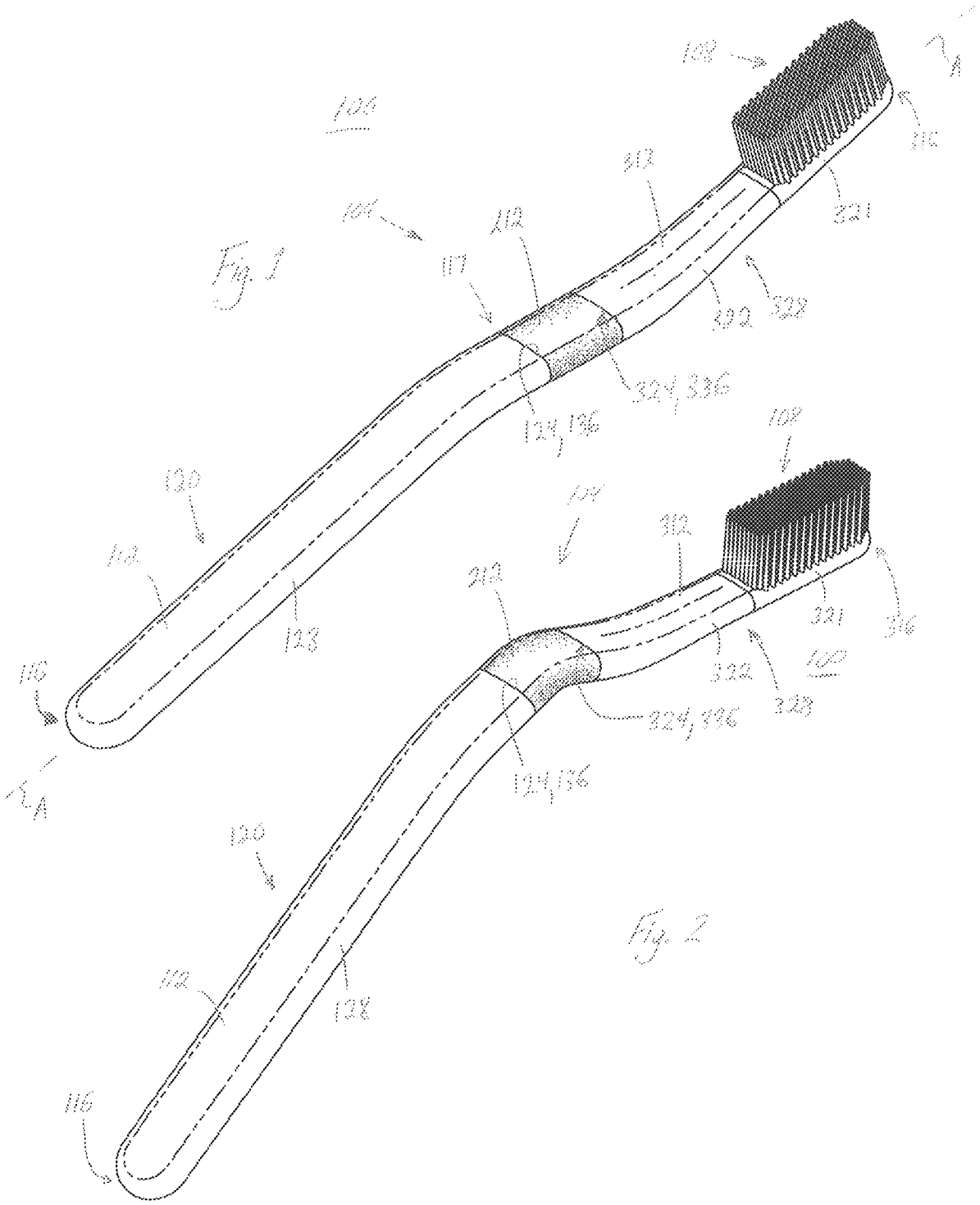
FIG. 1 is a simplified elevated perspective view of a toothbrush 100 according to an embodiment, in enabled condition with regular brushing contact enabled.
FIG. 2 is a simplified elevated perspective view of toothbrush 100 shown in FIG. 1, in disabled condition with regular brushing contact disabled.

In the following detailed description, reference is made to the accompanying drawings which form a part hereof, and in which is shown by way of illustration specific embodiments which may be practiced. These embodiments are described in sufficient detail to enable those skilled in the art to practice the embodiments and disclosure. It is to be understood that other embodiments may be utilized, and that logical, mechanical, electrical, and other changes may be made without departing from the scope of the embodiments and disclosure. In view of the foregoing, the following detailed description is not to be taken as limiting the scope of the embodiments or disclosure.

The terminology used herein is for the purpose of describing particular embodiments only and is not intended to be limiting. As used herein, the singular forms "a", "an", and "the" are intended to include the plural forms as well, unless the context clearly indicates otherwise. It will be further understood that the terms "comprises" and/or "comprising" or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

It will be appreciated that for simplicity and clarity of illustration, where considered appropriate, reference numerals may be repeated among the figures to indicate corresponding or analogous elements. In addition, numerous specific details are set forth in order to provide a thorough understanding of the implementations described herein. However, it will be understood by those of ordinary skill in the art that the implementations described herein may be practiced without these specific details. In other instances, well-known methods, procedures and components have not been described in detail so as not to obscure the implementations described herein. Also, the description is not to be considered as limiting the scope of the implementations described herein.

The detailed description set forth herein in connection with the appended drawings is intended as a description of exemplary embodiments in which the presently disclosed apparatus and system can be practiced. The term "exemplary" used throughout this description means "serving as an example, instance, or illustration," and should not necessarily be construed as preferred or advantageous over other embodiments.

FIG. 1 is a simplified elevated perspective view of a toothbrush 100 according to an embodiment, in an enabled condition with regular brushing contact enabled. Toothbrush 100 is simplified to illustrate subject matter of the present disclosure. In embodiments (not shown) toothbrush 100 may include any suitable configuration of handle dimensions, grip shape and texture, grip size and position, head shape and dimensions, bristle material and type, bristle size, bristle arrangement, and ornamental elements. FIG. 1 omits such details and alternative configurations.

As shown in FIG. 1, toothbrush 100 includes handle assembly 104 supporting brushing contact elements 108. Brushing contact elements 108 may include any suitable arrangement of bristles or analogous elements configured or arranged to contact teeth and gum tissues (hereinafter, the teeth, gum tissues or both, collectively, being "tissues") in manual brushing engagement with such tissues. In the particular arrangement shown in FIG. 1, the contact elements 108 are soft bristles of an injection molded bristle head. In embodiments (not shown), other brushing contact elements such as, for example, different types of bristles, may be used.

Figure 3:
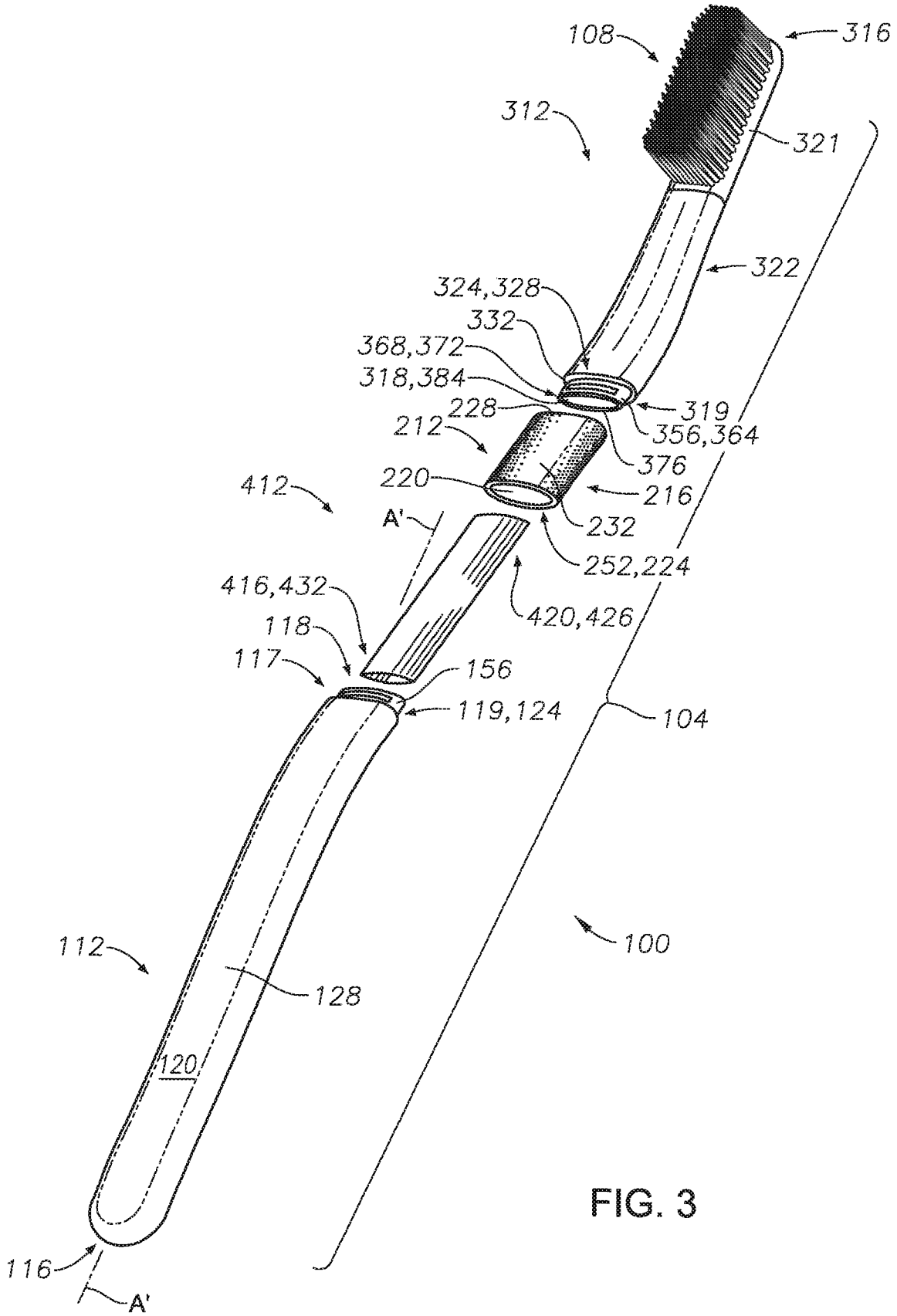

As shown in FIG. 1, handle assembly 104 may be assembled of multiple discreet components. Referring to FIG. 3, handle assembly 104 may include major handle member 112, major transition member 212, major head member 312 and major bridge assembly 412 including a pair of elongated biasing members 4. In other arrangements, handle assembly 104 may include one or more components, which may be described herein as discreet structures, being formed together or joined together by connecting elements such as, for example, one or more living hinges or other molded connecting structure. In an embodiment, for example, all non-metal components may be molded together in a single unit with connecting structure. In an embodiment (not shown) structures described herein as being formed of metal may be substituted, for example, by plastic materials, composite materials or other suitable molded materials which may be configured to perform essential functions. Handle assembly 104 may have a major longitudinal axis A-A extending through butt end 116 and head end 316. For this description, a major vertical reference plane (not shown) bisects the field of brushing contact elements 108 or bristles, and intersects a perpendicular major lateral reference plane (not shown) along major longitudinal axis A-A. It will be understood that major handle member 112 has a minor first longitudinal axis A'-A'; major transition member 212 has a minor second longitudinal axis B-B; major head member 312 has a minor third longitudinal axis C'-C'; and major bridge assembly 412 has a respective minor fourth longitudinal axis D'-D' longitudinal axis extends along the major longitudinal axis A-A of toothbrush 100, in a common lateral plane and deviating in vertical planes.

In the particular arrangement shown in FIG. 1, handle assembly 104 includes elongated major handle member 112 defining or having first longitudinal axis A'-A'. As shown in FIG. 1, major handle member 112 terminates at butt end 116. Major handle member 112 may include a major grip section 120 extending along first longitudinal axis A'-A' from butt end 116 to handle member connecting end 117. Handle member connecting end 117 begins at a shoulder 124. Major grip section 120 may include a continuous exterior spaced from first longitudinal axis A'-A' and defining major grip surface 128. Major grip section 120 including major grip surface 128 may terminate at shoulder 124. Shoulder 124 may extend at an angle to first longitudinal axis A'-A'. Major handle member 112 may include a shoulder flat 132 defined by shoulder 124 turning inward from major grip surface 128 at shoulder turn 136. The shoulder flat 132 may be defined perpendicular to first longitudinal axis A'-A'. As shown in FIG. 1, major handle member 112 includes a handle member second connection 119 defined by cooperation of shoulder flat 132 and a first male neck connection 148. The shoulder flat 132 defines a first annular stop surface 140 extending perpendicular to first longitudinal axis A'-A' between shoulder turn 136 and a first male neck connection 148. Major handle member 112 may include first male neck connection 148 configured to be received in mating engagement with a major transition member 212. The first male neck connection 148 may include a unitary, continuous first neck wall 156 originating at a first neck wall base 160 turning from shoulder flat 132 in the major longitudinal direction established by first longitudinal axis A'-A'. direction. First neck wall 156 may include a continuous first neck wall outer surface 164 extending from first neck wall base 160 to a first neck wall terminus 168 spaced apart from shoulder flat 132 in the major longitudinal direction. First neck wall 156 may include a first neck wall end surface 172 intersecting the first neck wall outer surface 164. The first neck wall end surface 172 may turn inward from the first neck wall outer surface 164 at the first neck wall terminus 168 at an angle, such as a perpendicular angle, in relation to first longitudinal axis A'-A'. The first neck wall 156 may include a continuous first neck wall inner surface 176 disposed in opposition to the first neck wall outer surface 164. The first neck wall inner surface 176 may originate in intersecting relationship with the first neck wall end surface 172 and extend back in the major longitudinal direction to terminate in intersection with a first cavity bottom wall 180. The first neck wall inner surface 176 in cooperation with the first cavity bottom wall 180 may define a first cavity 184. First cavity 184 may include a first cavity mouth 188 spaced apart from the first cavity bottom wall 180 in the major longitudinal direction. The first cavity mouth 188 thus may be an opening defined by an inner perimeter of the first neck wall terminus 168, located at the intersection of the first neck wall inner surface 176 with the first neck wall end surface 172. Major handle member 112 may include handle member first connection 118 including the first cavity 184 defined by cooperation of the first neck wall inner surface 176 in cooperation with the first cavity bottom wall 180, which may be configured to receive bridge first end 416 including biasing member first end 432. The handle member first connection 118 including first cavity 184 thus may define a female opening into which biasing member first end 432 of bridge first end 416 may be received, such as when inserted in assembling toothbrush 100. First cavity 184 may vary in diameter or size of the cavity opening, length of the cavity, cavity cross-sectional shape, or any of the preceding in combination, in relation to biasing member first end 432, to precisely specify a predetermined exact or precise load or grams of pressure necessary to cause inflection of the biasing member 428 of major bridge assembly 412 (shown in FIG. 10) at bridge hinge axis 448. In embodiments, biasing member first end 432 may vary in diameter or size, length, cross-sectional shape, or any of the preceding in combination, to precisely specify a predetermined exact or precise load or grams of pressure necessary to cause inflection of the biasing member 428 of major bridge assembly 412 (shown in FIG. 10) at bridge hinge axis 448.

The handle member first connection 118 thus may form a major connection with the bridge first end 416 including biasing member first end 432 of major bridge assembly 412. Handle member second connection 119 may form a major connection with transition first end 224 of major transition member 212.

In the particular arrangement shown in FIG. 1, handle assembly 104 includes elongated major head member 312 defining or having a third longitudinal axis C-C. For this description, a vertical reference plane (not shown) intersects a lateral reference plane (not shown) along third longitudinal axis C-C. As shown in FIG. 1, major head member 312 terminates at head end 316. Major head member 312 may include a minor head section 318 immediately beneath brushing contact elements 108. Major head member 312 may include minor throat section 320 adjoining minor head section 318 and formed in integral relationship therewith. Minor head section 320 may extend along third longitudinal axis C-C from head end 316 and beneath brushing contact elements 108 to adjoining minor throat section 320. Minor throat section 320 may extend along third longitudinal axis C-C from minor head section 318 to second shoulder 324. Major head member 312 may include a continuous exterior spaced from third longitudinal axis C-C and defining minor throat surface 328. Minor throat section 320 including minor throat surface 328 may terminate at second shoulder 324. Second shoulder 324 may extend at an angle to third longitudinal axis C-C. In the illustrated embodiment, second shoulder 324 extends perpendicular to third longitudinal axis C-C. Major head member 312 may include a second shoulder flat 332 defined by second shoulder 324 turning inward from minor throat surface 328 at second shoulder turn 336. The second shoulder flat 332 may be defined perpendicular to third longitudinal axis C-C. As shown in FIG. 3, the second shoulder flat 332 defines a second annular stop surface 340 extending perpendicular to third longitudinal axis C-C between second shoulder turn 336 and a second male neck connection 348. Major head member 312 may include second male neck connection 348 configured to be received in mating engagement with the major transition member 312. The second male neck connection 348 may include a unitary, continuous second neck wall 356 originating at a second neck wall base 360 turning from second shoulder flat 332 in the third longitudinal direction established by third longitudinal axis C-C. As shown in FIG. 3, major head member 312 includes a head member second connection 319 defined by cooperation of second shoulder flat 332 and a second male neck connection 348. Second neck wall 356 may include a continuous second neck wall outer surface 364 extending from second neck wall base 360 to a second neck wall terminus 368 spaced apart from second shoulder flat 332 in the third longitudinal direction. Second neck wall 356 may include a second neck wall end surface 372 intersecting the second neck wall outer surface 364. The second neck wall end surface 372 may turn inward from the second neck wall outer surface 364 at the second neck wall terminus 368 at an angle, such as a perpendicular angle, in relation to third longitudinal axis C-C. The second neck wall 356 may include a continuous second neck wall inner surface 376 disposed in opposition to the second neck wall outer surface 364. The second neck wall inner surface 376 may originate in intersecting relationship with the second neck wall end surface 372 and extend back in the third longitudinal direction to terminate in intersection with a second cavity bottom wall 380. The second neck wall inner surface 376 in cooperation with the second cavity bottom wall 380 may define a second cavity 384. Second cavity 384 may include a second cavity mouth 388 spaced apart from the second cavity bottom wall 380 in the third longitudinal direction. The second cavity mouth 388 thus may be an opening defined by an inner perimeter of the second neck wall terminus 368, located at the intersection of the second neck wall inner surface 376 with the second neck wall end surface 372. Major head member 312 may include head member first connection 318 including the second cavity 384 defined by cooperation of the second neck wall inner surface 376 in cooperation with the second cavity bottom wall 380, which may be configured to receive bridge second end 420 including biasing member second end 436. The head member first connection 318 including first cavity 384 thus may define a female opening into which biasing member second end 436 of bridge second end 420 may be received, such as when inserted in assembling toothbrush 100. First cavity 384 may vary in diameter or size of the cavity opening, length of the cavity, cavity cross-sectional shape, or any of the preceding in combination, in relation to biasing member second end 436, to precisely specify a predetermined exact or precise load or grams of pressure necessary to cause inflection of the biasing member 428 of major bridge assembly 412 (shown in FIG. 10) at bridge hinge axis 448. In embodiments, biasing member second end 436 may vary in diameter or size, length, cross-sectional shape, or any of the preceding in combination, to precisely specify a predetermined exact or precise load or grams of pressure necessary to cause inflection of the biasing member 428 of major bridge assembly 412 (shown in FIG. 10) at bridge hinge axis 448.

The head member first connection 318 thus may form a major connection with the bridge second end 420 including biasing member second end 436 of major bridge assembly 412. Head member second connection 319 may form a major connection with transition second end 228 of major transition member 212.

The major transition member 212 may have a tubular configuration. Major transition member 212 may include a continuous transition wall member 216 defining an open tubular transition passage 220 extending between transition first end 224 and transition second end 228 along a second longitudinal axis B-B. It will be understood that second longitudinal axis B-B is defined for reference in describing the illustrated embodiment, and for convenience is defined in relation to a regular enabling condition of major transition member 212. Transition wall member 216 may be formed of molded plastic or suitable material exhibiting sufficient flexibility and mechanical properties necessary to function as described herein. Transition wall member 216 may define a continuous transition exterior surface 232. Transition wall member 216 may define a contoured transition interior surface 236 disposed in opposition to transition exterior surface 232 and defining the open tubular transition passage 220. Transition wall member 216 may include a transition first terminus 244 defining the transition first end 224. The transition first terminus 244 is defined by a respective transition first turn 248 of transition wall member 216 from transition exterior surface 232 inward to intersect and join transition interior surface 236. The transition wall member 216 may include a transition first end surface 252 defined at transition first terminus 244 between transition exterior surface 232 and join transition interior surface 236. Transition first end surface 252 may be disposed at an angle, such as a perpendicular angle, to the second longitudinal axis B-B. The transition first end surface 252 may have or define an annular shape viewed in the second major longitudinal direction established by the second longitudinal axis B-B. It will be understood that, in handle assembly 104 as best shown in FIGS. 3 and 1, the transition first end surface 252 of major transition member 212 may have an annular shape that is a mirror image of the first annular stop surface 140 defined by shoulder flat 132 of major handle member 112, and may abut same in a major connection.

Transition wall member 216 may include a transition second terminus 260 defining the transition second end 224. The transition second terminus 260 is defined by a respective transition second turn 264 of transition wall member 216 from transition exterior surface 232 inward to intersect and join transition interior surface 236. The transition wall member 216 may include a transition second end surface 268 defined at transition second terminus 260 between transition exterior surface 232 and join transition interior surface 236. Transition second end surface 268 may be disposed at an angle, such as a perpendicular angle, to the second longitudinal axis B-B. The transition second end surface 268 may have or define an annular shape viewed in the second major longitudinal direction established by the second longitudinal axis B-B. It will be understood that, in handle assembly 104 and best shown in FIGS. 3 and 1, the transition second end surface 268 of major transition member 212 may have an annular shape that is a mirror image of a second annular stop surface 340 defined by a second shoulder flat 332 of a major head member 312, as described elsewhere herein, and may abut same in a major connection.

Figure 8:
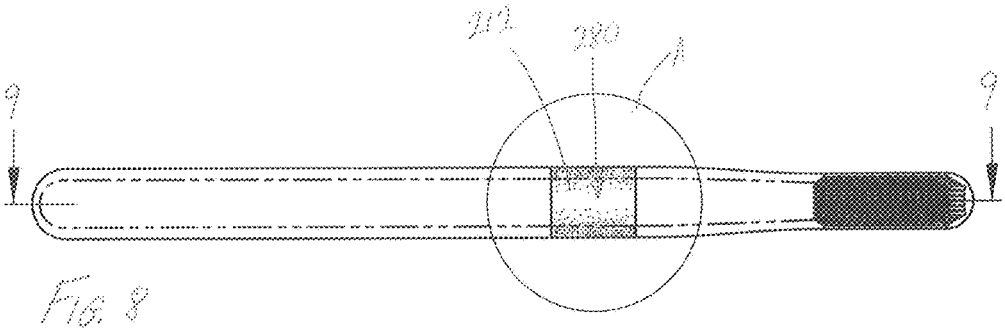
FIG. 8 is a simplified top view of toothbrush 100 in the enabled condition and taken generally along 8-8 in FIG. 1, with region of interest A.
Figure 9:
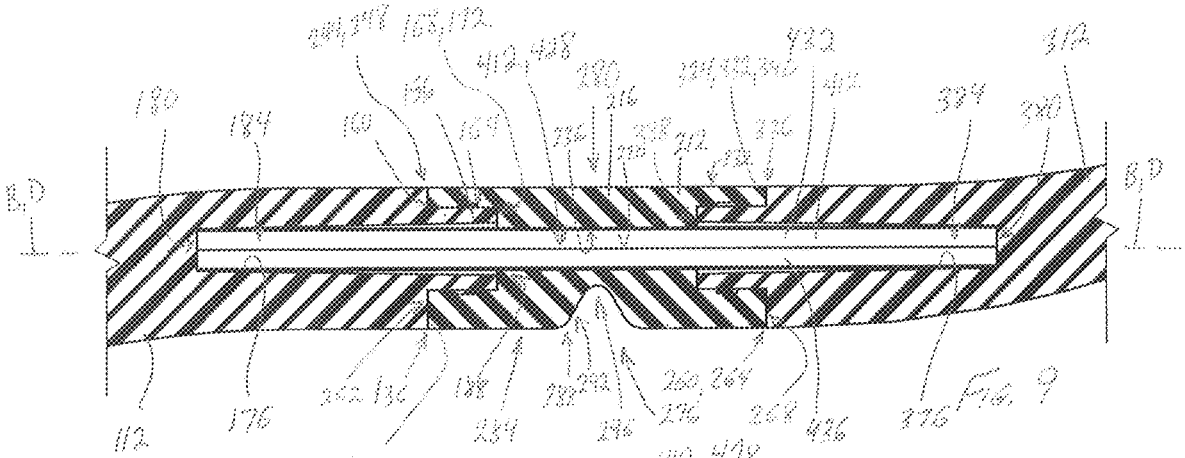
FIG. 9 is an enlarged simplified partial section view of toothbrush 100 in enabled condition and taken generally along 9-9 in FIG. 8, showing detail of region of interest A including a spring assembly thereof in enabling position.
Figure 10:
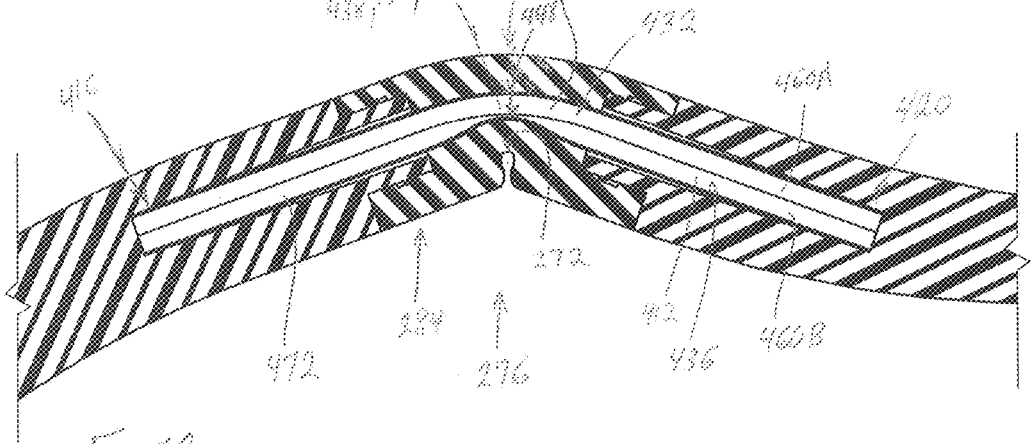
FIG. 10 is an enlarged partial section view similar to FIG. 9, of toothbrush 100 in disabled condition as shown generally in FIG. 2., showing detail of region of interest A including the spring assembly in disabling position.

As best shown in FIGS. 4, 5, 9 and 10, transition wall member 216 may include a flex notch 276 defined in transition exterior surface 232 at a location intermediate transition first terminus 244 and transition second terminus 260. In the particular embodiment shown in FIGS. 1-14, transition wall member 216 may include flex notch 276 defined in transition exterior surface 232 equidistant between transition first terminus 244 and transition second terminus 260. Major transition member 212 may have a designated top side 280 adjacent the brushing contact elements 108 and underside 284 opposite the top side 280 and brushing contact elements 108. Flex notch 276 may be formed in the bottom side 284 of transition wall member 216 to enable flexing of major transition member 212 from regular engaged position (shown in FIGS. 4 and 9) to overloaded disengaged position (shown in FIGS. 5 and 10) with regular brushing condition disengaged when a predetermined threshold force or load is exerted on the major bridge assembly 412 and transition wall member 216 at flex notch 276. As shown in FIGS. 4, 5, 9 and 10, flex notch 276 defines a notch gap 288 in transition exterior surface 232. Flex notch 276 includes a pair of intersecting notch walls 292 defining a V-profile from notch gap 288. The V-profile flex notch 276 extends from notch gap 288 of the transition exterior surface 232 towards transition interior surface 236. The V-profile flex notch 276 terminates intermediate the transition exterior surface 232 towards transition interior surface 236. The width of notch gap 288, depth of notch apex 296, and notch apex angle 298 formed between the intersecting notch walls 292 may be selected or configured to provide open clearance for transition wall member 216 to bend or flex without binding, through a desired range of flexing between the enabling position and disabling position when a predetermined force threshold of the major bridge assembly 412 is exceeded. As shown in FIG. 3, transition interior surface 236 and tubular transition passage 220 defined by same, are configured to receive and house major bridge assembly 412. As shown in FIGS. 9 and 10, transition interior surface 236 and tubular transition passage 220 are configured, particularly, both to receive and house major bridge assembly 412 in the straight, enabling position (shown in FIG. 9) which enables regular brushing, and in the flexed, disabling position (shown in FIG. 10), and for flexing motion of the major bridge assembly 412 between the straight, enabling position and flexed, disabled position. The open tubular transition passage 220 at transition first end 224 is aligned with first cavity mouth 188, for the major bridge assembly 412 to extend into first cavity 184 of major handle member 112. The open tubular transition passage 220 at transition second end 228 is aligned with second cavity mouth 388, for the major bridge assembly 412 to extend into second cavity 384 of major head member 312.

Figure 14:
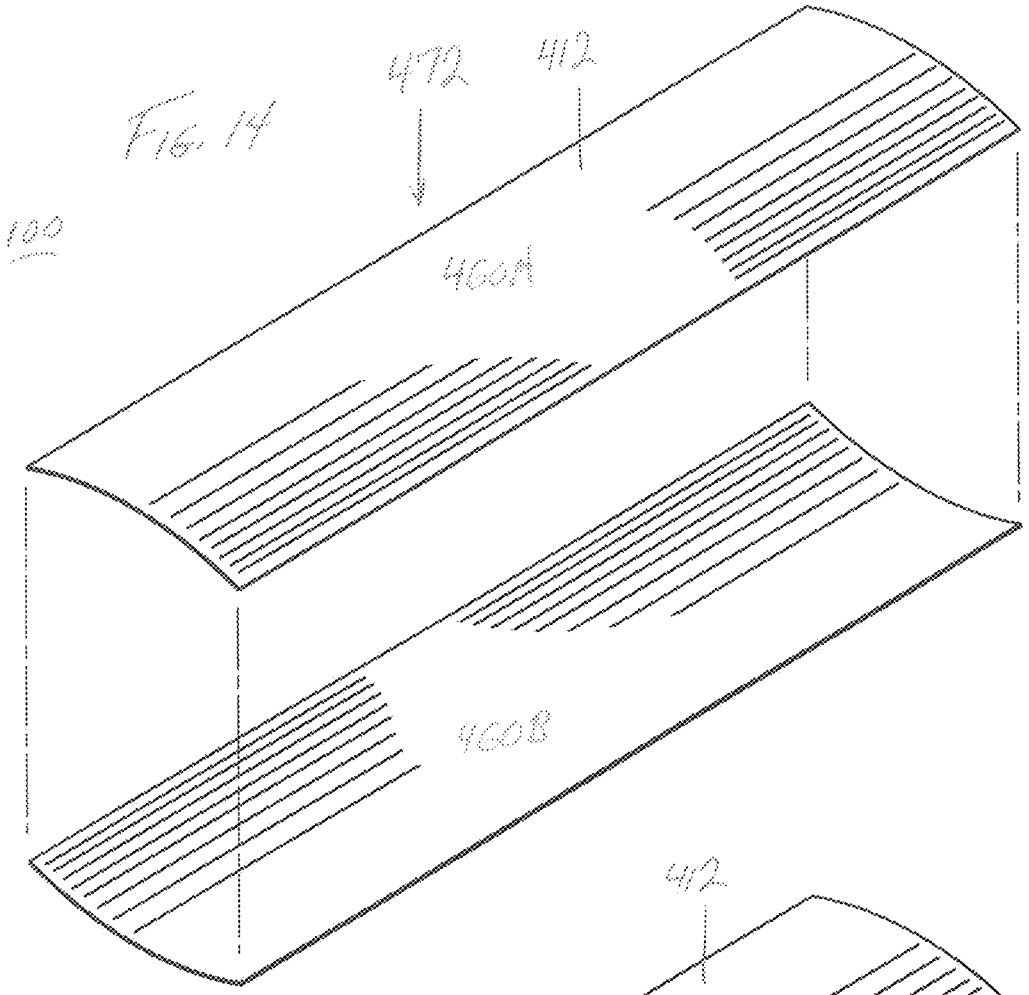
FIG. 14 is an exploded assembly view of the spring assembly shown in FIG. 13, showing components thereof.
Figure 13:
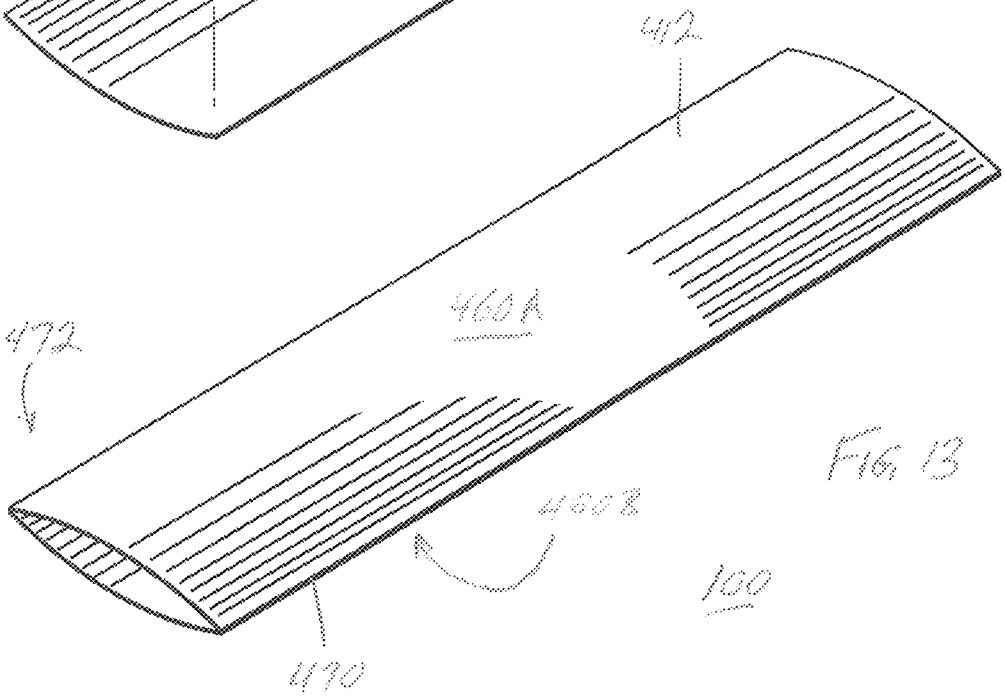
FIG. 13 is an enlarged isolation schematic perspective view similar to FIG. 12A, illustrating the spring assembly in enabling position and sub-threshold shape.

Referring to FIG. 3, handle assembly 104 may include major bridge assembly 412. Major bridge assembly 412 may extend from first cavity 184 of major handle member 112 through open tubular transition passage 220 of major transition member 212 and into second cavity 384 of major head member 312. Major bridge assembly 412 may include a bridge assembly first end 416 received in mating engagement with handle member first connection 118. Major bridge assembly 412 may include a bridge assembly second end 420 received in mating engagement with head member first connection 318. Major bridge assembly 412 may include at least one biasing member 428 configured to give way or flex about bridge hinge axis 448 under predetermined threshold force or load on major bridge assembly 412 and biasing member 428. It will be understood that the biasing member 428 may be configured to provide biasing force resistant to flexing or displacement and remain in the straight, enabling position (shown in FIGS. 1 4, and 9) when loaded less than the threshold force or load, and to give way, inflect and flex to be displaced from the straight, enabled position (shown in FIGS. 1, 4 and 9) to the flexed, disabled position (shown in FIGS. 2, 5 and 10) when loaded at or in excess of the threshold force or load. It will be understood that the biasing member 428 may be selected and configured to receive and bear force or load less than or up to the predetermined threshold and then yield, inflect and flex from the straight, enabled position to the flexed, disabled position where the threshold pressure or load is met or exceeded. The permissible threshold force or load at which the resilient biasing member 428 of major bridge assembly 412 may be predetermined to yield, inflect and flex for flexing movement about bridge hinge axis 448, to provide a corresponding protective threshold of maximum brushing pressure that is permitted to be exerted by the brushing contact members 108 against tissues to be protected during regular brushing usage. Referring to FIGS. 13-14, in the particular embodiment shown, biasing member 428 may include a paired set of first and second elongated flexible, resilient leaf spring biasing members 460A, 460A. Again referring to FIGS. 13 and 14, the biasing member 428 may include a paired set of first and second elongated flexible, resilient sheet metal biasing members 460A, 460B (shown in FIG. 14) each shaped to have a curved, semi-elliptical cross-section profile (shown in FIGS. 11B and 12B). As best shown in FIG. 14, the pair of resilient sheet metal biasing members 460A,460B may be disposed in opposition with edges aligned in abutting relationship with each other, thus forming a biasing member assembly 472 wherein bias forces may be exerted in opposite directions. Referring to FIG. 9, the pair of resilient sheet metal biasing members 460A,460B may be elongated with a biasing member first end 432 and opposite biasing member second end 436. As shown in FIG. 9, the elongated biasing member first end 432 may be received in mating engagement with the handle member first connection 118 and biasing member second end 436 may be received in mating engagement with the head member first connection 318, and a biasing member intermediate section 438 may be received in mating engagement with transition interior surface 236 of major transition member 212 therebetween. In other embodiments (not shown), the sheet metal biasing members 460A, 460A may not be identical. As best shown in FIG. 14, in the illustrated embodiment, each of the identical resilient sheet metal biasing members 460A, 460B may have a curved inner surface 466 disposed in parallel opposition to curved outer surface 468. Each of the identical flexible, resilient sheet metal biasing members 424A, 424B may have a rectangular periphery 470 an opposed pair of elongated sides 444 intersecting an opposed pair of identical ends 448.

FIG. 2 is a simplified elevated perspective view of toothbrush 100 shown in FIG. 1, in disabled condition with regular brushing contact disabled. Toothbrush 100 includes major handle member 112 joined to major transition member 212. Toothbrush 100 includes major head member 312 joined to major transition member 212 opposite major handle member 112. Major transition member 212 is seen in the flexed, disabled position corresponding to flexing of the major bridge assembly (412, shown in FIG. 5).

FIG. 3 is a simplified perspective exploded view of toothbrush 100 shown in FIG. 1. Handle assembly 104 may include major handle member 112, major transition member 212, major head member 312. Handle assembly 104 includes major bridge assembly 412 configured to extend between the major handle member 112, major transition member 212, major head member 312 with identical outer surfaces of the paired set of identical flexible, resilient sheet metal members 460A, 460B engaged in mating relationships with corresponding of the following: first neck wall inner surface 176 and first cavity bottom wall 180 of major handle member 112, second neck wall inner surface 376 and second cavity bottom wall 380 of major head member 312, and contoured transition interior surface 236 of major transition member 212. It will be understood that forces are transferred into, through and out of the paired set of identical flexible, resilient sheet metal members 460A, 460B by engagement in the aforementioned mating relationships with handle member first connection 118 of major handle member 112, head member first connection 318 of major head member 312, and contoured transition interior surface 236 of major transition member 212.

Figure 4:
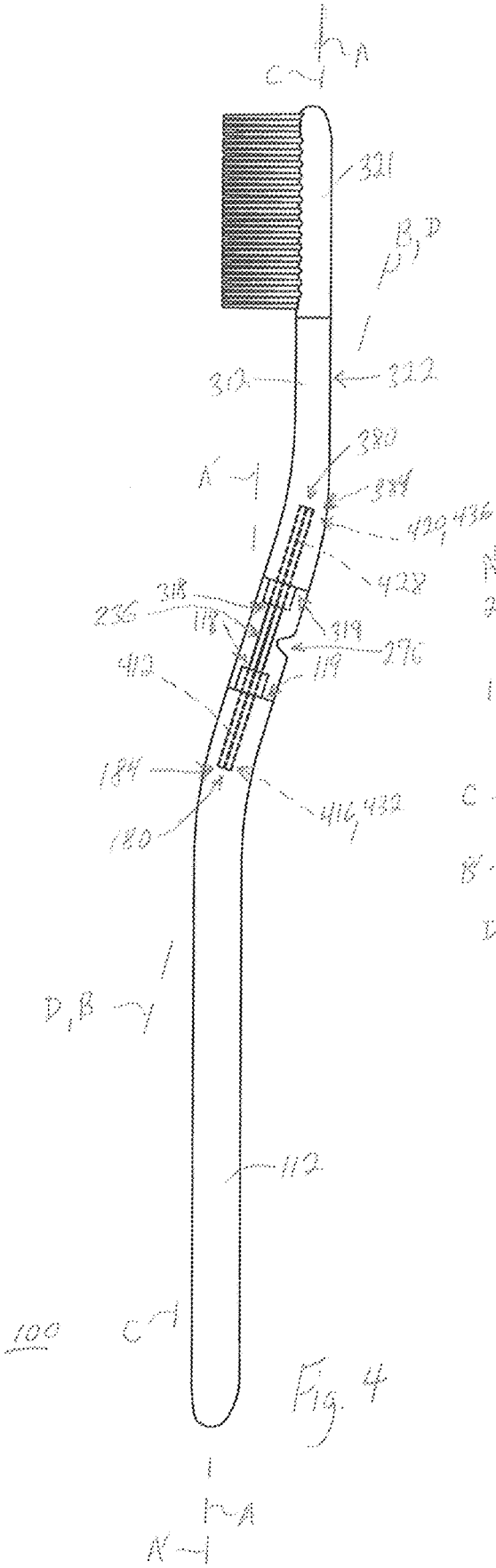
FIG. 4 is a simplified schematic side view of toothbrush 100 in enabled condition and taken generally along 4-4 in FIG. 1.

FIG. 4 is a simplified schematic side view of toothbrush 100 in enabled condition and taken generally along 4-4 in FIG. 1. The major bridge assembly 412 including the paired set of elongated, flexible resilient sheet metal members 460A, 460B is shown in the straight, enabling position with the major handle member 112, major transition member 212 and major head member 312 aligned for regular brushing use.

Figure 5:
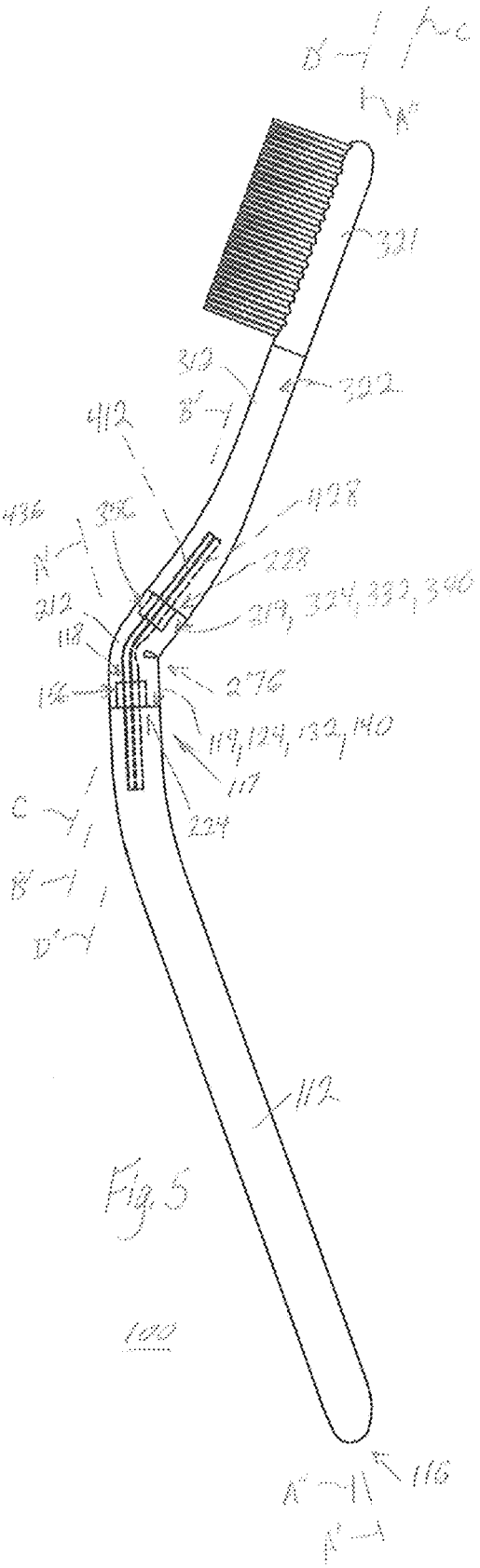
FIG. 5 is a simplified schematic side view of toothbrush 100 in the disabled condition and taken generally along 5-5 in FIG. 2.

FIG. 5 is a simplified schematic side view of toothbrush 100 similar to FIG. 4, but in the disabled condition and taken generally along 5-5 in FIG. 2. The major bridge assembly 412 including the paired set of elongated, flexible resilient sheet metal members 460A, 460B is shown in the flexed, disabling position with major transition member 212 flexed away from the straight, enabling position and the major head member 312 in disabled position spaced apart from the regular brushing position (shown in FIGS. 1 and 4).

Figure 6:
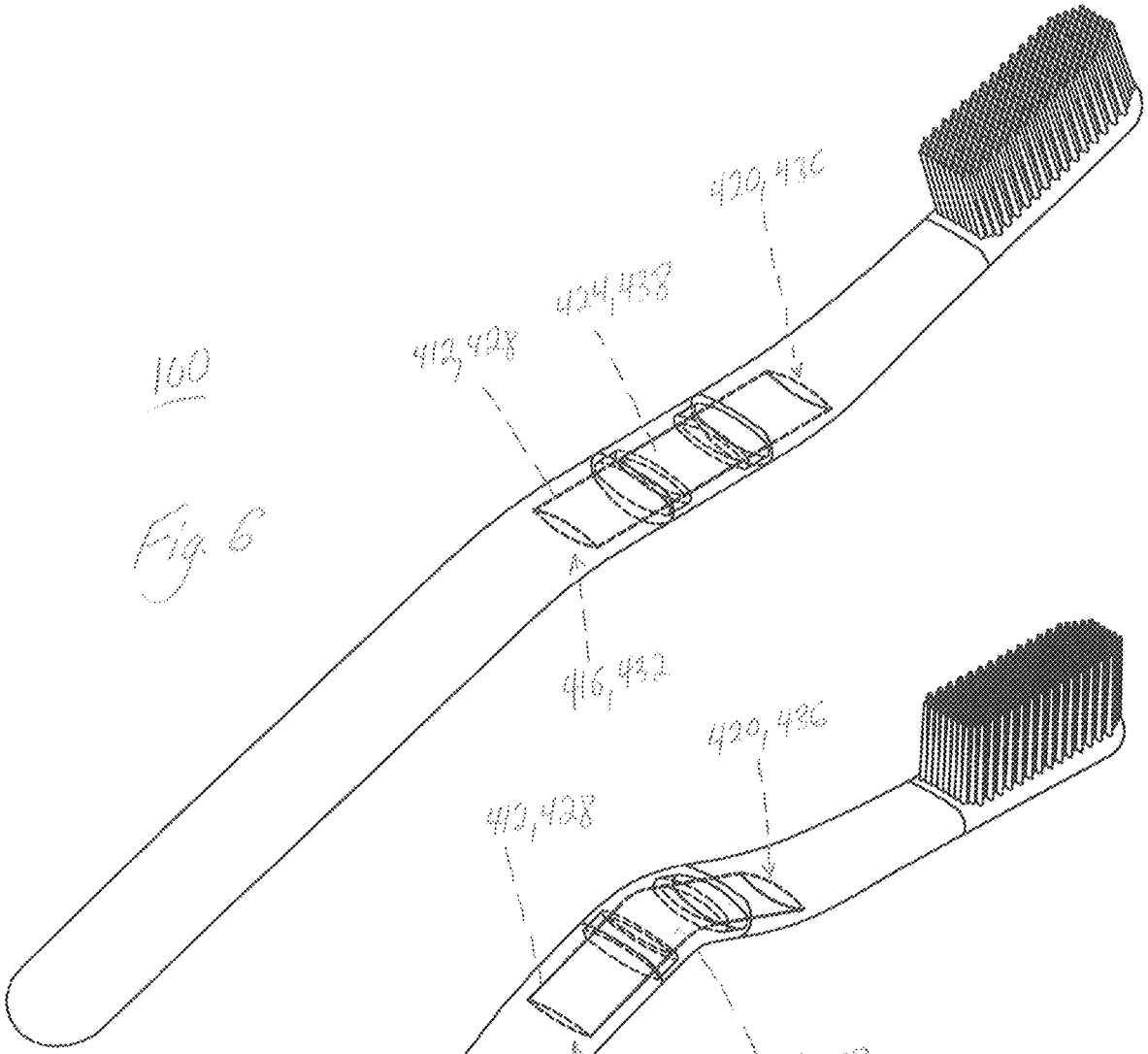
FIG. 6 is a simplified schematic perspective view of toothbrush 100 in the enabled condition and taken generally along 4-4 in FIG. 1, with internal structure shown in broken lines.

FIG. 6 is a simplified schematic perspective view of toothbrush 100 in the enabled condition and taken generally along 4-4 in FIG. 1, with internal structure shown in broken lines. The internal structure includes major bridge assembly 412 shown in broken lines.

Figure 7:
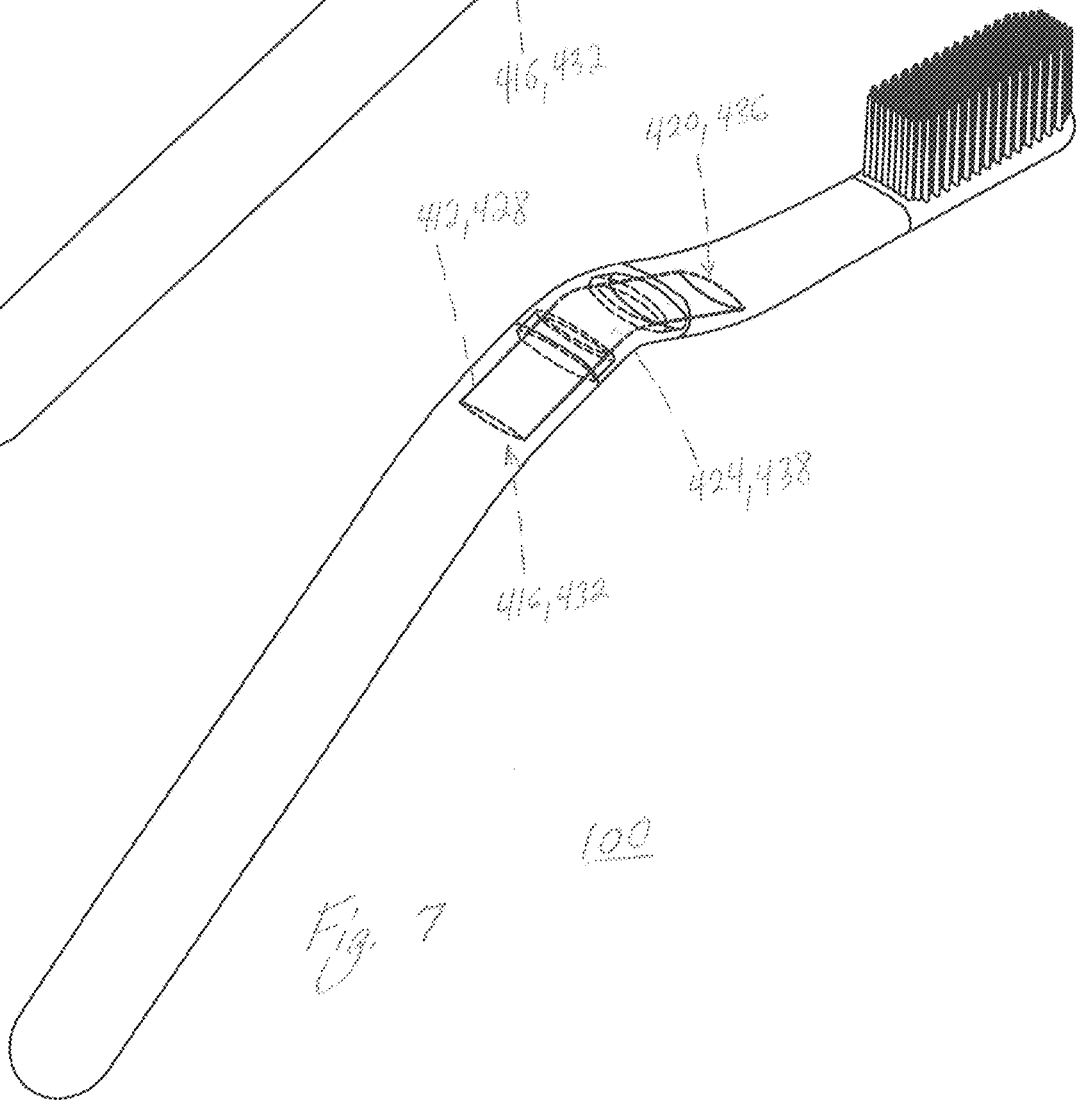
FIG. 7 is a simplified schematic perspective view of toothbrush 100 in the disabled condition and taken generally along 5-5 in FIG. 2, with internal structure shown in broken lines.

FIG. 7 is a simplified schematic perspective view of toothbrush 100 in the disabled condition and taken generally along 5-5 in FIG. 2, with internal structure shown in broken lines. The internal structure includes major bridge assembly 412 shown in broken lines.

FIG. 8 is a simplified top view of toothbrush 100 in the enabled condition and taken generally along 8-8 in FIG. 1, with region of interest A including the major transition member 212. Top side 280 is shown.

FIG. 9 is an enlarged simplified partial section view of toothbrush 100 in enabled condition and taken generally along 9-9 in FIG. 8, showing detail of region of interest A, including the major bridge assembly 412 with the pair of elongated flexible, resilient sheet metal biasing members 460A, 460B thereof in straight, enabling position. Major transition member 212 includes flex notch 276 located in bottom side 284 of transition wall member 216. Flex notch 276 includes an open notch gap 288 defined in transition exterior surface 232. Flex notch 276 includes a pair of opposed notch walls 292 intersecting at notch apex 296. Notch apex 296 defines transition hinge axis 272 proximate bridge hinge axis 448 of flexible, resilient sheet metal biasing members 460A,460B of major bridge member 412. The flex notch 276 includes a notch apex angle 298 defined between the pair of notch walls 292. Flex notch 276 is shown in open, enabled position with the notch gap 288 at full width and notch apex angle 298 at fully open position. FIG. 9 also shows force transferring mating engagement between the identical flexible, resilient sheet metal members 460A, 460B in straight, enabling position and engaged in mating relationships with corresponding of the following: handle member first connection 118 defined by first neck wall inner surface 176 and first cavity bottom wall 180 of major handle member 112, head member first connection 318 defined by second neck wall inner surface 376 and second cavity bottom wall 380 of major head member 312, and contoured transition interior surface 236 of major transition member 212. Also shown is handle member second connection 119 defined by first neck wall outer surface 164 and shoulder flat 132 of major handle member 112, which is shown in mating engagement with transition first end 224 of major transition member 212. Also shown is head member second connection 319 defined by second neck wall outer surface 364 and second shoulder flat 332 of major head member 312, which is shown in mating engagement with transition second end 228 of major transition member 212.

FIG. 10 is an enlarged partial section view similar to FIG. 9, of toothbrush 100 in disabled condition as shown generally in FIG. 2., showing detail of region of interest A including the major bridge assembly 412 with the pair of flexible, resilient sheet metal biasing members 460A, 460B thereof in flexed, disabling position. The major transition member 212 includes flex notch 276 located in bottom side 284 of transition wall member 216. Flex notch 276 includes a notch gap 288 defined in transition exterior surface 232. Flex notch 276 includes a pair of opposed notch walls 292 intersecting at notch apex 296. Notch apex 296 defines transition hinge axis 272. Major transition member 212 may flex and pivot about transition hinge axis 272 in common with flexing of the pair of flexible, resilient sheet metal biasing members 460A, 460B of major bridge assembly 412 about the bridge hinge axis 448. The flex notch 276 includes a notch apex angle 298 defined between the pair of notch walls 292. Flex notch 276 is shown in closed, disabled position with the notch gap 288 at minimum width and notch apex angle 298 at fully closed position.

FIG. 11A is an enlarged isolation schematic perspective view illustrating the the major bridge assembly 412 with the paired set of elongated, flexible resilient sheet metal members 460A, 460B in enabling position and in a low load shape as shown in FIG. 9, corresponding to toothbrush 100 in the enabled condition shown generally in FIG. 9.

FIG. 11B is a schematic cross-section view taken generally along 11B-11B in FIG. 11A, illustrating the paired set of elongated, flexible resilient sheet metal members 460A, 460B in enabling position and low load shape.

FIG. 12A is an enlarged isolation schematic perspective view similar to FIG. 11A, illustrating the paired set of elongated, flexible resilient sheet metal members 460A, 460B in enabling position and sub-threshold shape, corresponding to toothbrush 100 in the enabled condition shown generally in FIG. 9.

FIG. 12B is a schematic cross-sectional view taken generally along 12B-12B in FIG. 12A, illustrating the paired set of elongated, flexible resilient sheet metal members 460A, 460B in enabling position and sub-threshold shape.

FIG. 13 is an enlarged isolation schematic perspective view similar to FIG. 12A, illustrating the paired set of elongated, flexible resilient sheet metal members 460A, 460B in enabling position and sub-threshold shape.

FIG. 14 is an exploded assembly view of the spring assembly shown in FIG. 13, showing components thereof including the paired set of elongated, flexible resilient sheet metal members 460A, 460B.

Apparatus according to embodiments of the disclosure are described. Although specific embodiments are illustrated and described herein, it will be appreciated by those of ordinary skill in the art that any arrangement which is calculated to achieve the same purposes can be substituted for the specific embodiments shown. This application is intended to cover any adaptations or variations of the embodiments and disclosure. For example, although described in terminology and terms common to the field of art, exemplary embodiments, systems, methods and apparatus described herein, one of ordinary skill in the art will appreciate that implementations can be made for other fields of art, systems, apparatus or methods that provide the required functions. The invention should therefore not be limited by the above described embodiment, method, and examples, but by all embodiments and methods within the scope and spirit of the invention.

In particular, one of ordinary skill in the art will readily appreciate that the names of the apparatus and elements are not intended to limit embodiments or the disclosure. Furthermore, additional elements may be added to the components, functions can be rearranged among the components, and new components to correspond to future enhancements and physical devices used in embodiments can be introduced without departing from the scope of embodiments and the disclosure. One of skill in the art will readily recognize that embodiments are applicable to future apparatus and different materials. The use of any and all examples, or exemplary language (e.g., "such as"), is intended merely to better illustrate the disclosure and does not pose a limitation on the scope of the disclosure unless otherwise claimed. No language in the specification should be construed as indicating any non-claimed element as essential to the practice of the disclosure as used herein. Terminology used in the present disclosure is intended to include all environments and alternate technologies that provide the same functionality described herein.

What is claimed is:

1. A toothbrush protective of tissues, said toothbrush comprising:

a set of brushing contact members at a head end;

an elongated toothbrush handle assembly comprising said head end, said toothbrush handle assembly comprising a butt end spaced apart from said head end, said toothbrush handle assembly having a major longitudinal axis extending through said butt end and said head end;

said toothbrush handle assembly comprising a major bridge assembly comprising a biasing member, said major bridge assembly comprising a bridge assembly first end, said major bridge assembly comprising a bridge assembly second end spaced apart from said bridge assembly first end, said bridge assembly second end disposed in opposition to said bridge assembly first end, said major bridge assembly comprising a bridge assembly intermediate section intermediate said bridge assembly first end and said bridge assembly second end, said bridge assembly intermediate section comprising said biasing member, said biasing member comprising a bridge hinge axis perpendicular to said major longitudinal axis, said major bridge assembly configured for flexing movement about said bridge hinge axis;

said toothbrush handle assembly comprising a major transition member comprising a continuous transition wall member, said transition wall member defining an open tubular passage extending from a transition member first end to a transition member second end, said transition wall member including a transition member interior surface configured to receive at least said bridge assembly intermediate section in mating engagement therewith, said major transition member comprising a transition member hinge axis intermediate said transition member first end to said transition member second end, said transition member hinge axis proximate said bridge hinge axis to enable pivoting motion of said major transition member about said transition member hinge axis in common with flexing motion of said major bridge assembly about said bridge hinge axis when said biasing member is loaded in excess of a predetermined threshold;

said toothbrush handle assembly comprising a major handle member including said butt end, said major handle member including a handle member connection end opposite said butt end, said handle member connection end including a handle member first connection configured to receive said bridge assembly first end in mating engagement therewith, said handle member connection end including a handle member second connection configured to receive said transition member first end in mating engagement therewith; and said toothbrush handle assembly comprising a major head member including said head end, said major handle member including a head member connection end opposite said head end, said head member connection end including a head member first connection configured to receive said bridge assembly second end in mating engagement therewith, said head member connection end including a head member second connection configured to receive said transition member second end in mating engagement therewith, wherein said biasing member comprises a flexible resilient sheet biasing member, the flexible resilient sheet biasing member comprising a pair of rectangular leaf spring biasing members each having a semi-elliptical shape, said pair disposed in opposition to provide a rectangular leaf spring assembly having elliptical shape perpendicular to said major longitudinal axis.

2. The toothbrush according to claim 1, wherein said transition wall member comprises a flex notch including a notch apex, said flex notch apex defining said transition member hinge axis at a notch apex.

3. The toothbrush according to claim 1, wherein said biasing member comprises a biasing member first end spaced from a biasing member second end disposed in opposition thereto, said bridge assembly first end comprising said biasing member first end, said bridge assembly second end comprising said biasing member second end.

4. The toothbrush according to claim 1, wherein said pair of rectangular leaf spring biasing members extend into mating engagement with said handle member first connection, through said transition tubular passage of said major transition member in mating engagement with said transition interior surface, into mating engagement with said head member first connection.

5. The toothbrush according to claim 1, wherein said mating engagement with said handle member first connection providing a first load at said bridge assembly first end, said mating engagement with said head member first connection providing a second load at said bridge assembly second end, said pair of rectangular leaf spring biasing members providing bias force balancing said first load and said second load unless a predetermined threshold load is exceeded, said pair of rectangular leaf spring biasing members yielding at said bridge assembly hinge axis when said predetermined threshold load is exceeded.

6. A toothbrush protective of tissues, said toothbrush comprising:

a set of brushing contact members at a head end;

an elongated toothbrush handle assembly comprising said head end, said toothbrush handle assembly comprising a butt end spaced apart from said head end, said toothbrush handle assembly having a major longitudinal axis extending through said butt end and said head end;

said toothbrush handle assembly comprising an elongated biasing member, said biasing member comprising a biasing member first end, said biasing member comprising a biasing member second end spaced apart from said biasing member first end, said biasing member second end disposed in opposition to said biasing member first end, said biasing member comprising a bridge hinge axis perpendicular to said major longitudinal axis, said biasing member configured for flexing movement about said bridge hinge axis;

said toothbrush handle assembly comprising a major transition member having a transition member first end and a transition member second end disposed in opposition thereto, said major transition member including a transition member hinge axis perpendicular to said major longitudinal axis, said transition member hinge axis proximate said bridge hinge axis, said major transition member configured for flexing movement about said transition member hinge axis in common with flexing movement of said biasing member about said bridge hinge axis;

said toothbrush handle assembly comprising a major handle member including said butt end, said major handle member including a handle member connection end opposite said butt end, said handle member connection end including a handle member first connection configured to receive said biasing member first end, said handle member connection end including a handle member second connection configured to receive said transition member first end; and said toothbrush handle assembly comprising a major head member including said head end, said major handle member including a head member connection end opposite said head end, said head member connection end including a head member first connection configured to receive said biasing member second end, said head member connection end including a head member second connection configured to receive said transition member second end, wherein said biasing member comprises a flexible resilient sheet biasing member, the flexible resilient sheet biasing member comprising a pair of rectangular leaf spring biasing members each having a semi-elliptical shape, said pair disposed in opposition to provide a rectangular leaf spring assembly having elliptical shape perpendicular to said major longitudinal axis.

* * * * *